US005861000A

United States Patent [19]

Takashima

[11] Patent Number: 5,861,000

[45] Date of Patent: Jan. 19, 1999

[54] APPARATUS FOR RELEASING CONGESTED PROSTATE FLUID

[76] Inventor: Jiro Takashima, 7203 Schiller, Houston, Tex. 77055

[21] Appl. No.: 818,525

[22] Filed: Mar. 31, 1997

Related U.S. Application Data

[63] Continuation of Ser. No. 645,523, May 14, 1996.

[51] Int. Cl.[6] ..... A61M 29/00

[52] U.S. Cl. ..... 606/197; 606/196

[58] Field of Search ..... 606/197, 196, 606/191; 128/61, 62

[56] References Cited

U.S. PATENT DOCUMENTS 2,478,786 8/1949 Smallen ..... 128/61

2,974,666 3/1961 Coumbis et al. ..... 606/197

5,681,265 10/1997 Maeda et al. ..... 606/197

*Primary Examiner*—Michael Buiz

*Assistant Examiner*—Kevin Truong

*Attorney, Agent, or Firm*—Harrison & Egbert

[57] ABSTRACT

An apparatus for releasing congested prostate fluid including a head having a size suitable for fitting into a human rectum and through a sphincter and having a surface for pushing on a prostate gland, a rod connected to a bottom of the head and extending outwardly therefrom so as to guide a movement of the head as the sphincter relaxes and contracts, and an abutment member positioned on the rod opposite the head so as to push on the perineum area simultaneously with the head pushing on the prostate gland. The abutment means has a variable angular relationship with the head. The angular relationship is greater upon entry into the rectum and less upon pushing on the perineum and the prostate.

11 Claims, 3 Drawing Sheets

APPARATUS FOR RELEASING CONGESTED PROSTATE FLUID

RELATED APPLICATION

The present application is a continuation of U.S. patent application Ser. No. 08/645,523, filed on May 14, 1996 now pending, and entitled "APPARATUS FOR RELEASING CONGESTED PROSTATE FLUID", presently pending.

TECHNICAL FIELD

The present invention relates to apparatus for the treatment of prostatitis. More particularly, the present invention relates to devices for massaging the prostate gland.

BACKGROUND ART

One treatment for non-bacterial disorder of prostate such as chronic prostatitis and a congested prostate is the prostate massage. Some urologists believe that the most effective treatment for such prostatitis is for the doctor to massage the prostate at regular intervals. Such massages can be difficult to obtain. In any event, the regular and repeated massaging of the prostate can often require frequent visits to the doctor's office. This causes the patient to incur a considerable expense and an inconvenience. As such, a need has developed for allowing an individual to carry out his own prostatic massage.

In the past, some patents have issued relating to rectal devices U.S. Pat. No. 4,542,753, issued on Sep. 23, 1985 to Brenman et Describes an apparatus and method for stimulating penile erectile tissue. In this invention, a body is provided which may be inserted into the rectum of a user. The body is shaped so as to closely conform to the topological configuration of the rectum within the anal area to a site adjacent to the prostate gland. Electrical circuitry for generating a neurally stimulating electrical signal is located within the body. Electrodes, placed at particular locations on the surface of the body, apply the signal to the user. At least one of the electrodes closely contacts the prostate gland when the body member is operatively disposed, at a region or spot on the prostate gland previously determined to be sensitive to electrical stimulation.

U.S. Pat. No. 5,404,881, issued on Apr. 11, 1995, to Cathaud et al. describes a trans-rectal probe. This trans-rectal probe includes a probe body made of a flexible self-supporting polymer material whose degree of flexibility is designed to enable it to comply with the shape therein. The invention makes it possible to achieve safe and reliable positioning of an instrument for detection or therapeutic treatment level with the organ to be observed or treated. In particular. This device is designed for treatment of the prostate.

U.S. Pat. No. 2,478,786, issued on Aug. 9, 1949 to H. M. Smallen describes a prostate gland massaging implement. This implement includes a lever having an interior handle which constitutes a power arm to extend down in front of the abdomen and a substantially horizontal portion extending under the groin and offset laterally to avoid the genital organs. The implement has an upwardly and forwardly bent posterior portion which forms the work arm. This work arm extends into the rectal passage to bear against the frontal wall thereof adjacent the prostate gland. The bent portion between the horizontal and the posterior portions serves as a fulcrum point against the front wall of the rectal opening when the implement is subject to pivotal movement around this point.

It is an object of the present invention to provide an apparatus which enables persons to carry out self-massages of the prostate so as to express the fluid from the congested prostate.

It is an object of the present invention to provide an apparatus which simultaneously provides finger pressure therapy effects on the perineum region.

It is an object of the present invention to provide an apparatus which provides hand free massage operations on the prostate perineum region by utilizing the sphincter's contraction and relaxation to massage the prostate-perineum region.

It is a further object of the present invention to provide an apparatus for a prostate massage which is safe, easy to use, and inexpensive.

SUMMARY OF THE INVENTION

The present invention is an apparatus for do-it-yourself release of congested prostate fluid. This apparatus converts the sphincter's contraction and relaxation activity to an up-and-down motion to massage the prostate and push up the perineum region simultaneously.

This apparatus comprises a head means having a size suitable for fitting into a human rectum and through a sphincter and having a surface suitable for rubbing a prostate gland, and a head means having a suitable size which is tapered so as to narrow one side toward the rod means. This apparatus provides a grip by the sphincter, and converts a sphincter's lateral thrust force to the upward movement of the head.

The rod means, of C-shaped configurations, has a radius of curvature such that the rod contacts the perineum-groin area to give the back tension to the head so that the head is movably positioned within the tile portion of the sphincter. This back tension provides a clearance for the head to move, such that the head can be moved up and down inside the tile portion of the sphincter and the rectum as the sphincter contracts and relaxes.

The rod also guides a movement of the head means toward the prostate and pushes it as the sphincter contracts, and returns to original position when the sphincter relaxes. An abutment member is fixed to the rod means distal the head means so as to contact a perineum area and push up the spot of the perineum area as the sphincter contracts, thus the prostate is grabbed between the head and the abutment member to squeeze out congested prostatic fluid.

The rod has a smaller diameter than a diameter of the head. The rod extends outwardly in a direction facing one side of the head.

The abutment surface includes a raised area which is affixed on the rod opposite the head. This raised area extends upwardly from the rod so as to contact the perineum area when the head is in the rectum. The abutment surface is adjustably affixed to the rod so as to vary a distance from the head. The abutment surface also has an adjustable distance extending above the rod.

DETAILED DESCRIPTION OF THE INVENTION

Figure 1:
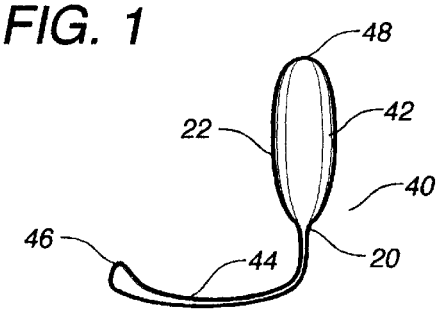
FIG. 1 is a side elevational view of the apparatus of the present invention.

FIG. 1 shows at 40 the apparatus of the present invention for massaging a prostate rectally to release congested prostate fluid. The apparatus 40 includes a head 42, a rod 44 connected to a bottom of the head 42, and an pointed abutment surface 46 in raised relationship relative to the rod 44.

In FIG. 1, it can be seen that the head 42 is an elongated member having a generally ellipsoidal configuration. In general, the head 42 is rounded at the top 48 and also tapered off toward the bottom 20 adjacent to the rod 44. The head 42 provides a sufficient length and a surface 22 facing the abutment surface 46 for suitably rubbing a prostate gland. The head 42 has a size suitable for fitting into a human rectum and through the sphincter.

The head 42 is a rigid or rubber-like material and the rod 44 is a rigid or springy. The rod 44 has a generally L-shaped configuration.

The abutment surface 46 rises upwardly from the rod 44 at an end of the rod 44 opposite the head 42. The purpose of the abutment surface 46 is to push up on the sensitive spot on the perineum-groin area so as to give an acupressure-like therapy effect to stimulate an area for some therapeutic purposes.

Figure 2:
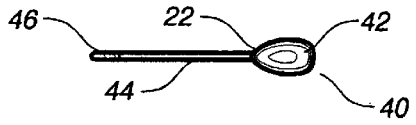
FIG. 2 is a plan view of the apparatus of FIG. 1.

FIG. 2 is a plan view of the apparatus 40. In particular, it can be seen that the head 42 has side 22 facing the rod 44 and the abutment surface 46. The head 42 narrows in diameter toward side 22. The narrow area of the side 22 creates greater forces that can be imparted onto the prostate. It can also be seen in FIG. 2 that the rod 44 and the abutment surface 46 are co-planar with the longitudinal axis of the head 42.

Figure 3:
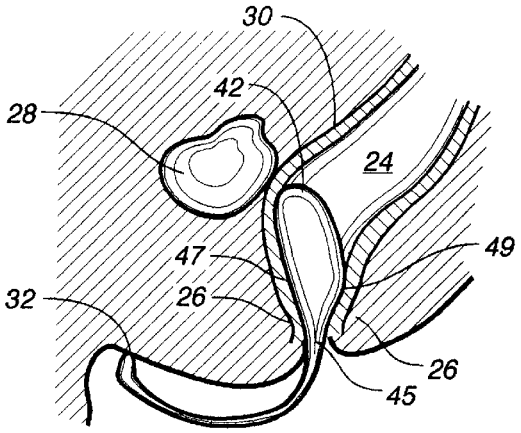
FIG. 3 is a side elevational view of the operation of the apparatus of the present invention with the sphincter relaxed.

FIG. 3 shows the first position of the apparatus 40 of the present invention. FIG. 3 shows that the tapered portion of the head 45 is held within a tile portion of the sphincter 26 and a top portion of the head lightly pushes on prostate 28 through the rectum wall 30. It can be seen that the lower portion of the head 45 is gently tapered toward the rod 44 for easier moving within the tile portion of the sphincter 26, and this tapered portion of the head 45 serves as a grip to the sphincter 26 against the pull tension by the rod 44 and also as a converter of a sphincter's lateral thrust force to a pushing upward force to the head 42.

The rod 44 works to give a refractive tension to the head 42, and to guide the head 42 toward the prostate 28. The rod 44 works as a stop to limit the depth of the head insertion into a rectum 24.

The curvature of the rod 44 is set so that when the head 42 is inserted into a rectum and the rod 44 contacts the perineum groin area 32, the rod 44 adds an refractive tension to the head 42. This tension is achieved by the angle of the curvature and resilience of the rod and the elasticity of the human tissues. This tension is necessary to hold the tapered portion of the head 45 movably within a tile portion of the sphincter 26 so as to offset push up effects of the head 42 caused by a lateral thrust of the sphincter 26. This refractive tension to the head 42 provides a moving clearance for the head 42 to react to the sphincter's contraction. This moving distance is determined by an inclined angle and a length of the tapered portion of the head 45 which is affected by the sphincter's activity, the strength of the refractive tension of the rod 44, and the elasticity of the human body tissues.

Figure 4:
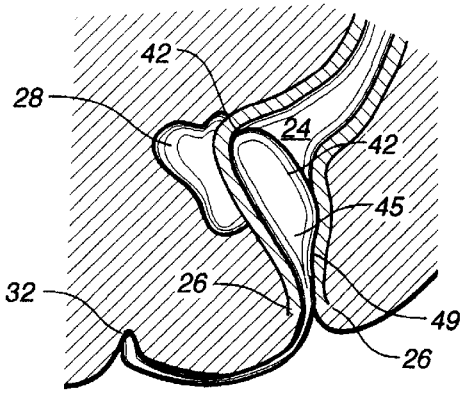
FIG. 4 is a side elevational view of the operation of the apparatus of the present invention with the sphincter contracted.

FIG. 4 shows a second position of the apparatus 40. When the sphincter contracts, the stronger lateral thrust force of the sphincter 26 to the lower tapered portion of the head 45 prevails over the refractive tension of the rod 44 so as to allow the head 42 to be pushed up toward a prostate 28 guided by the rod 44. As a result, the head 42 presses the prostate 28 and the rod 44 pushes up on the perineum-groin area 32 simultaneously. As a safety precaution, the rod 44 is made of a resilient material such as spring wire and plastics. The elastic limit of the rod is within a certain amount of pressure in which a safety range in which the head pushes the prostate within a certain amount of the pressure, and when the stress is greater than the elastic limit of the rod, the rod yields to the stress. The direction of the head 42 is guided by the curvature of the rod 44 and by the head 42. When the sphincter 26 relaxes, the rod 44 pulls the head 42 back to the first position. As a result, the head 42 can be moved up and down within the tile portion of the sphincter 26 and the rectum 24 as the sphincter 26 contracts and relaxes. It can be seen that the lower portion of the head 45, which is positioned in a tile portion of the sphincter, has a crescent shaped configuration with the arc shape on the back of the head 49 and the chord shape is on the front of the head 47. This crescent shaped configuration has a radius of curvature such that when the sphincter contracts, the head 42 is pushed up frontward by the sphincter 26 and guided toward the prostate 28.

Figure 5:
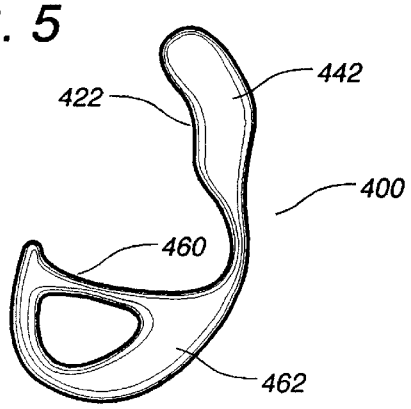
FIG. 5 is a side elevational view of an alternative embodiment of the present invention.
Figure 6:
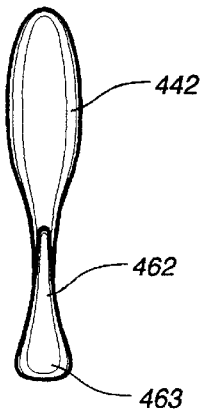
FIG. 6 is a front elevational view of an alternative embodiment of the present invention.

FIG. 5 shows an another embodiment of the present invention originally illustrated in FIGS. 1–4. It can be seen the abutment rod combination surface 460 is stretched downwardly to provide a flat side or a disk-shaped area. As shown in FIG. 6, the vertical central line of the abutment-handle 462 is coplanar to the axis of the longitudinal head 442 and enables it to control the position of the head 442 to the right or the left side lobe of the prostate by tilting the bottom of the abutment-handle area 463 laterally. The angle between the head surface 422 and the abutment-rod combination surface 460 is smaller than the angle between the prostate and the perineum line so that when the head is inserted into a human rectum, the head surface 22 is slightly pushing a prostate. When the sphincter contracts, the head 442 further moves toward the prostate to push harder.

Figure 7:
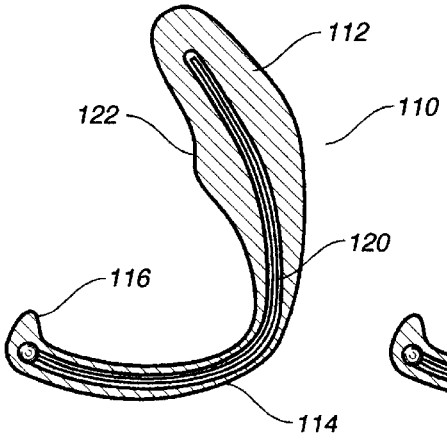
FIG. 7 and 8 are cross sectional view of an alternative embodiment of the present invention.
Figure 8:
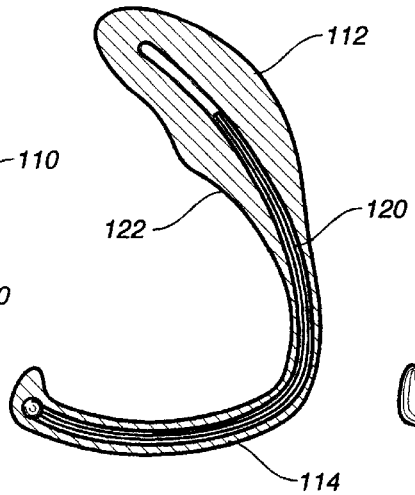
Figure 9:
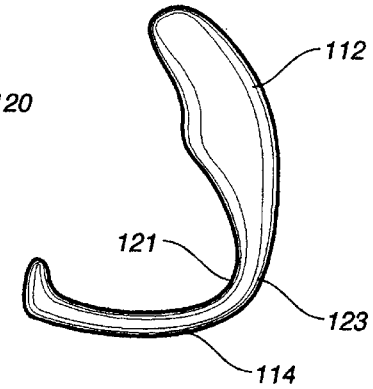
FIG. 9 is a side elevational view of an alternative embodiment of the present invention.

FIG. 7 shows a cross-sectional view of a form of the present invention as originally illustrated in FIGS. 1–4. This embodiment shows one of the functions in that the head 112 can be directionally stretchable when the head 112 is pulled. The head 112 returns to its original position by its refractive tension when the force is removed. In particular, it can be seen that the apparatus 110 includes a central member 120 which is fixed to the end of the rod 116, and is slidably installed into the head 112. The head 112 is made by the rigid or firm rubber-like material and the rod 114 is made of an elastic stretchable material. As shown in FIG. 8, when the head is pulled, the rod allows the head to stretch directionally following the curvature of the central member 120. This directional head extension pushes the prostate. In addition, the head extension narrows the angle between the head surface 122 and the abutment 116 to add more pressure on both the prostate and the perineum-groin area. Also this directional head movement can be done by adopting variant degrees of elastic materials to the rod, for example, as shown FIG. 9, usage of more elastic material outer side of the curvature 123 of the rod 114 than that of the inner side of the curvature 121 causes the head to stretch toward the inside when the head is pulled upwardly.

Figure 10:
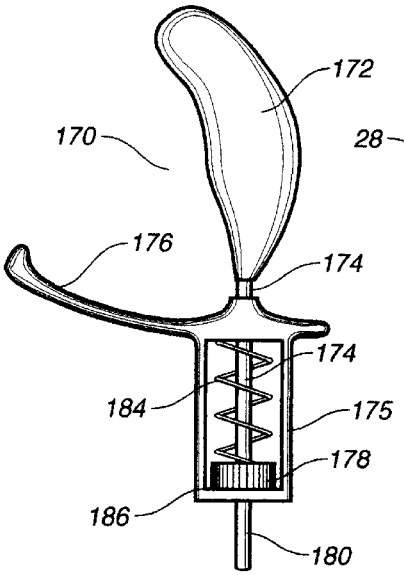
FIG. 10 is a cross sectional view of an alternative embodiment of the present invention.

FIG. 10 shows embodiment 170 of the apparatus of the present invention. In particular, it can be seen that the head 172 is formed of a construction similar to that of the previous embodiment. The rod 174 extends linearly outwardly from the bottom of the head 172. The rod 174 is received within a housing 175. Importantly, the threaded rod 180 includes a stop member 178 such that the refractive tension for the head and the clearance of movement of the head 172 by the sphincter's contraction and relaxation can be adjusted. The housing 175 includes a central housing area which contains the threaded stop member 178 and portion 180 of the rod 174. The housing 175 also has a curved surface 176 which forms the "abutment member" of the present invention. The curved surface 176 is affixed to the housing 175 and extends outwardly therefrom. The curved surface 176 will serve to push on the perineum area simultaneously with the pushing of the head 172 on the prostate gland. A spring 184 extends around the rod portion 174 and 180 and is interposed between the stop member 178 and the curved surface 176. The spring 184 serves to resiliently urge the stop member 178 toward the end surface 186 of the housing 175. The spring 184 will also serve to exert a pushing action on the curved surface 176 when the head 172 is drawn upwardly and downwardly through the sphincter. As such, the curved surface 176 is useful in the relieving of congested prostate fluid and massaging the acupressure spot on a perineum-groin area.

Figure 11:
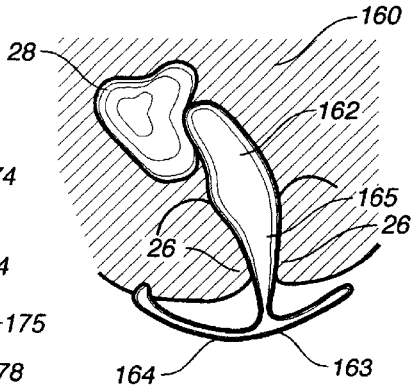
FIG. 11 and FIG. 12 show the operation of an alternative embodiment of the present invention.

FIG. 11 shows embodiment 160 of the present invention. In particular, it can be seen that the head 162 is formed of a construction similar to that of the previous embodiment. The bottom of the head 163 is connected at an angle to the concave side of the curved abutment 164. This concave-shaped abutment resiliently holds the lower tapered portion of the head 165 within a tile portion of the sphincter 26 and urge away from an entrance of the sphincter 26 and a concave surface of the abutment 164 so as to provide a clearance for the head 162 to move. This movable clearance is not only the actual space between an entrance of said sphincter and the abutment surface but also count on the elasticity of the human body tissues.

Figure 12:
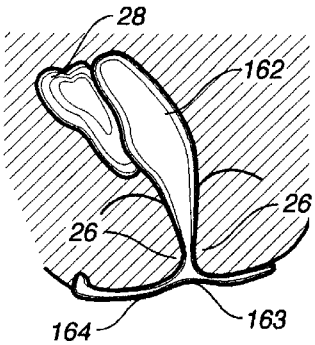
Figure 13:
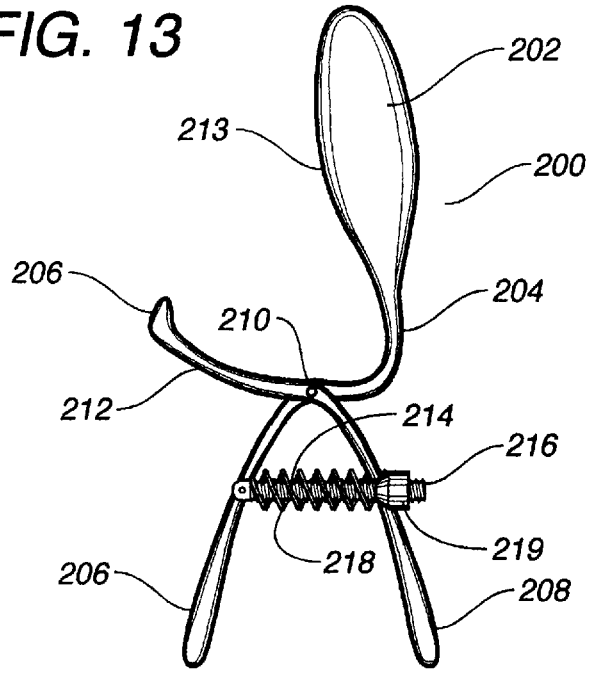
FIG. 13–15 show an side elevational view of an alternative embodiment of the present invention and show, in particular, the operation of this alternative embodiment.
Figure 14:
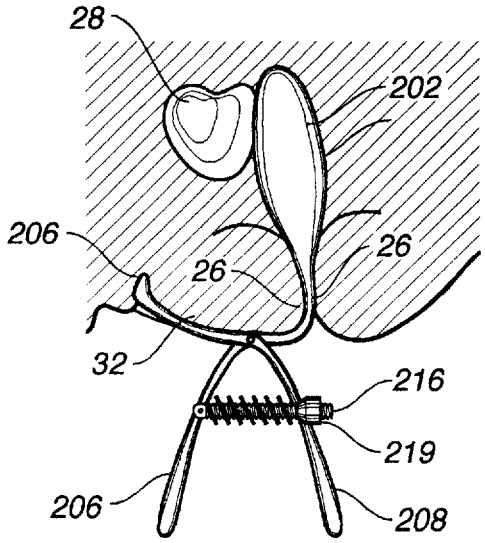
Figure 15:
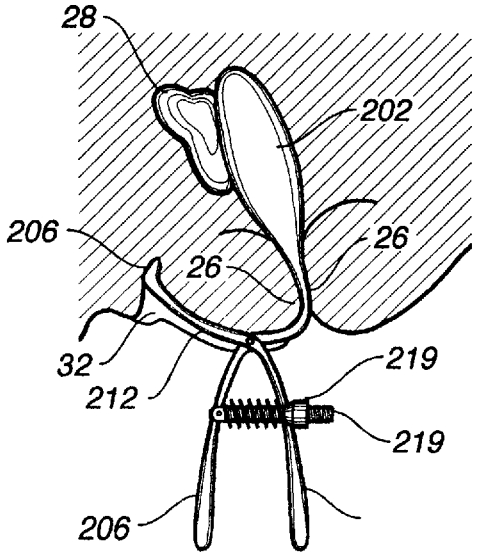

FIG. 12 shows when the sphincter 26 contracts, the abutment 164 resiliently yields to the sphincter's stronger lateral pressure. This allows the head 162 to move up toward the prostate 28 to push it strongly, guided by the head 120 abutment 124 connected angle. FIG. 13 shows another alternative embodiment 200 of the present invention. The apparatus 200 includes a head 202 that includes a rod 204 which extends outwardly from a bottom of the head 202. A handle 206 is connected to or integrally formed with the rod 204. A second handle 208 is pivotally connected at 210 to the rod 204.

The handles 206 and 208 create a "scissor-like" action therebetween. The abutment member 212 extends outwardly from the second handle 208. The abutment member 212 can create the necessary squeezing action on the perineum area, in conjunction with the head 202, so as to relieve congested prostate fluid.

The apparatus 200 is adjustable so as to vary the angular relationship between the abutment member 212 and the head 202. In particular, a member 214 extends from handle 206 and through handle 208. The member 214 has a threaded portion 216 which extends outwardly of the handle 208. A spring 218 extends over the member 214 so to resiliently urge the handle 208 angularly away from handle 206. A nut 219 is affixed over the threaded portion 216 so as to fix the distance between the handle 206 and 208. The handles 206 and 208 can be pushed together manually so as to effectively squeeze the prostate fluid from the rectal side and the perineum side simultaneously or they can be retained in a desired angular relationship so that the natural action of the sphincter will cause such simultaneous squeezing action.

FIG. 16 shows the head 202 as positioned so as to push on the prostate gland 28. As can be seen, the head 202 is positioned adjacent to the prostate 28 for the effective massaging action. The rod 204 extends upwardly through the sphincter 26. Importantly, it can be seen that the abutment arm 212 is positioned so as to push on the perineum area 32 simultaneously with the pushing on the prostate gland 28. This is accomplished by narrowing the angle of between the handle 206 and the handle 208. As can be seen, the nut 219 is tightened on the threaded portion 216 so as to effectively draw the handles 206 and 208 together. This will cause a pivoting at the pivot point 210 so as to cause the abutment arm 212 to rotate and to push on the perineum area 32. As can be seen in FIG. 17, greater pushing effect can be accomplished by further closing the distance between the handles 206 and 208. Once again, the nut 219 is tightened on the threaded portion 216 so as to draw the handles 206 and 208 together. This causes the abutment member 216 to strongly push on the perineum are 32. This also causes the head 202 to push harder on the prostate 28. As can be seen, the apparatus 200 presents an effective device for accomplishing the release of congested prostate fluid while allowing for greater adaptability between the various individuals.

The foregoing disclosure and description of the invention is illustrative and explanatory thereof. Various changes in the details of the illustrated apparatus may be made within the scope of the appended claims without departing from the true spirit of the invention. The present invention should only be limited by the following claims an their legal equivalents.

I claim:

1. An apparatus for releasing congested prostate fluid comprising:

a head having a size suitable for fitting into a human rectum and through a sphincter, said head having a surface for pushing on a prostate gland, said head having a generally ellipsoidal shape, said head being formed of a firm rubberlike material;

a rod means connected to a bottom of said head and extending outwardly therefrom, said rod means for guiding a movement of said head as the sphincter contracts and relaxes; and an abutment means positioned on said rod means opposite said head, said abutment means for pushing onto a perineum area simultaneously with said head pushing on the prostate gland, said rubberlike material extending over and around said rod means and said abutment means.

2. The apparatus of claim 1, said rod means comprising:

a rod having a generally L-shaped or C-shaped configuration, said configuration having a radius of curvature such that said head is positioned close to the prostate gland and is guided toward the prostate gland as the sphincter contracts and draws said head upwardly in the rectum.

3. The apparatus of claim 1, further comprising:

an internal member of resilient construction, said internal member extending into said head and along said rod means, said abutment means formed on said internal member opposite said head.

4. The apparatus of claim 1, said abutment means comprising:

a finger member mounted on said rod means and extending upwardly therefrom, said finger member having a generally pointed end above said rod means.

5. The apparatus of claim 4, said finger member being slidably mounted on said rod means so as to be movable along said rod means.

6. The apparatus of claim 5, said finger member being formed of a firm elastomeric material.

7. The apparatus of claim 1, said abutment means comprising:

a roller rotatably mounted onto said rod means opposite said head, said roller having a surface extending above said rod means, said surface for pushing on the perineum area.

8. The apparatus of claim 1, further comprising:

a first handle connected to said rod means; and a second handle connected to said abutment means and pivotally connected to said rod means, said second handle being in scissor-like relationship with said first handle.

9. The apparatus of claim 8, further comprising:

an adjustment means connected to said first and second handle so as to adjust an angular relationship between said head and said abutment means.

10. An apparatus for releasing congested prostate fluid comprising:

a head having a size suitable for fitting into a human rectum and through a sphincter, said head having a surface for pushing on a prostate gland;

a rod means connected to a bottom of said head and extending linearly outwardly of said head, said rod means for guiding a movement of said head as said sphincter contracts and relaxes; and an abutment means positioned on said rod means opposite said head, said abutment means for pushing onto a perineum area simultaneously with said head pushing on the prostate gland, said abutment means being a housing receiving said rod, said housing having a curved surface extending outwardly therefrom.

11. The apparatus of claim 10, further comprising:

a stop means affixed to said rod means within said housing, said stop means for limiting a linear movement of said rod means; and a spring means mounted on said rod means and extending between said stop means and said curved surface of said abutment means, said spring means for exerting a compressive force onto said curved surface.

* * * * *